US011650012B1

(12) United States Patent
Ellis

(10) Patent No.: US 11,650,012 B1
(45) Date of Patent: May 16, 2023

(54) NOZZLE PLATES FOR A CARPET DRYER

(71) Applicant: Michael A. Ellis, Lookout Mountain, GA (US)

(72) Inventor: Michael A. Ellis, Lookout Mountain, GA (US)

( * ) Notice: Subject to any disclaimer, the term of this patent is extended or adjusted under 35 U.S.C. 154(b) by 0 days.

(21) Appl. No.: 17/242,107

(22) Filed: Apr. 27, 2021

Related U.S. Application Data

(63) Continuation-in-part of application No. 16/383,593, filed on Apr. 13, 2019, now abandoned.

(51) Int. Cl.
*F26B 21/00* (2006.01)
*F26B 3/06* (2006.01)
*D06F 60/00* (2009.01)

(52) U.S. Cl.
CPC ..... *F26B 21/004* (2013.01); *D06F 60/00* (2013.01); *F26B 3/06* (2013.01); *D10B 2503/04* (2013.01)

(58) Field of Classification Search
CPC .... F26B 21/004; F26B 13/104; F26B 13/108; F26B 3/06; D06F 60/00; A47L 9/08; D10B 2503/04
USPC ..... 34/641, 643
See application file for complete search history.

(56) References Cited

U.S. PATENT DOCUMENTS 3,230,636 A * 1/1966 Daane ..... F26B 13/16 34/122
3,272,415 A * 9/1966 Wallin ..... B65G 51/03 242/615.11
3,964,656 A * 6/1976 Hella ..... B65H 23/24 34/640
4,173,831 A * 11/1979 McCord ..... F26B 21/004 34/236
4,551,926 A * 11/1985 Aufderhaar ..... F26B 21/004 34/465
5,946,819 A * 9/1999 Reimer ..... F26B 13/12 34/643

FOREIGN PATENT DOCUMENTS

EP 2684660 A1 * 1/2014 ..... B28B 11/241

* cited by examiner

*Primary Examiner* — Jessica Yuen
(74) *Attorney, Agent, or Firm* — Quickpatents, LLC; Kevin Prince

(57) ABSTRACT

A nozzle system for a carpet drying machine includes two or more planar diffusion plates each having a manifold side and a carpet side. The diffusion plates each include a plurality of apertures traversing from the manifold side to the carpet side. Each aperture is wider at the manifold side than at the carpet side so as to define a concentrating nozzle through the diffusion plate. Preferably the concentrating nozzles of each diffusion plate flare outwardly progressively increasingly from the carpet side of the diffusion plate to the manifold side of the diffusion plate. As such, with the two or more diffusion plates mounted in two or more manifolds of the carpet drying machine, with the manifold side of the diffusion plate facing away from the carpet web, hot air blown into the manifolds is concentrated into a laminar flow towards the carpet web to dry the carpet web.

15 Claims, 5 Drawing Sheets

NOZZLE PLATES FOR A CARPET DRYER

CROSS-REFERENCE TO RELATED APPLICATIONS

This application is a continuation-in-part of U.S. patent application Ser. No. 16/383,593, filed Apr. 13, 2019, the contents of which are herein incorporated by reference.

STATEMENT REGARDING FEDERALLY SPONSORED RESEARCH AND DEVELOPMENT

Not Applicable.

FIELD OF THE INVENTION

This invention relates to carpet drying, and more particularly to a nozzle system for a carpet drying machine.

BACKGROUND

Carpet drying machines of the prior art use so-called "jet tube" diffusion plates to direct air towards a carpet web that either needs to be dried or needs to be heated to facilitate a chemical reaction between materials introduced to the carpet web. Such carpet drying machines include one or more furnaces with one or more blowers for directing air into at least a pair of manifolds disposed on either side of the carpet web that travels through the carpet drying machine to be dried. The jet tube diffusion plates of the prior art are thin and include a plurality of apertures, typically in a grid pattern, that receive air from the manifold and deliver it to the carpet web. However, such air traversing an aperture in a thin plate is subject to quick diffusion and is typically non-laminar. Further, the grid pattern on typical jet tube diffusion plates create gaps of drying between such apertures, where the warm air blown through the diffusion plates does not reach all parts of the carpet web uniformly. Further, such prior art diffusion plates are difficult to remove from the manifolds and are notoriously difficult to clean.

Therefore, there is a need for a carpet drying system that includes diffusion plates that are relatively easy to remove from the carpet drying machine and clean. Such diffusion plates would provide overlapping or interspersed coverage of heated drying air to the carpet web, and would do so with multiple interspersed laminar flow jets. The present invention accomplishes these objectives.

SUMMARY OF THE INVENTION

The present device is a nozzle system for a carpet drying machine of the type having an upper manifold with a lower open end, and a lower manifold with an upper open end.

Each manifold is in fluid communication with at least one furnace and a blower to deliver heated air through the manifold to a carpet web disposed between each manifold.

The nozzle system comprises two or more planar diffusion plates each having a manifold side and a carpet side. The diffusion plates each include a plurality of apertures traversing from the manifold side to the carpet side. Each aperture is wider at the manifold side than at the carpet side so as to define a concentrating nozzle through the diffusion plate.

Preferably the concentrating nozzles of each diffusion plate flare outwardly progressively increasingly from the carpet side of the diffusion plate to the manifold side of the diffusion plate. Preferably each diffusion plate includes two or more rows of the concentrating nozzles, each concentrating nozzle of one row being offset from the concentrating nozzles of any adjacent row of concentrating nozzles. Preferably each concentrating nozzle include only rounded, non-sharp edges that inhibit snagging on the carpet web.

With the two or more diffusion plates mounted at each of the open ends, each diffusion plate preferably is adapted to rest in either manifold by gravity at the open end of each manifold, respectively. Each diffusion plate is preferably rectangular in plan view, and possibly square in plan view when multiple of the diffusion plates are required to completely cover the open end of each manifold. As such, each diffusion plate abuts any adjacent diffusion plate along a cooperative edge that inhibits air flow between the adjacent diffusion plates.

As such, with the two or more diffusion plates mounted at each of the manifolds with the manifold side of the diffusion plate facing away from the carpet web, hot air blown into the manifolds is concentrated into a laminar flow towards the carpet web to dry the carpet web.

In some embodiments, the nozzle system is added to a preexisting carpet drying machine with minimal retrofitting required to the upper and lower manifolds. In other embodiments, the carpet drying machine is included, the carpet drying machine including at least one furnace and at least one blower, each disposed in a penthouse of an enclosure. In some embodiments each manifold may include its own furnace and blower. A plurality of such carpet drying machines may be daisy-chained or attached for more thorough drying of the carpet web in a continuous drying process.

The present invention is a carpet drying system that includes diffusion plates that are relatively easy to remove from the carpet drying machine and clean. The present invention provides overlapping or interspersed coverage of heated drying air to the carpet web, and does so with multiple interspersed laminar flow jets. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
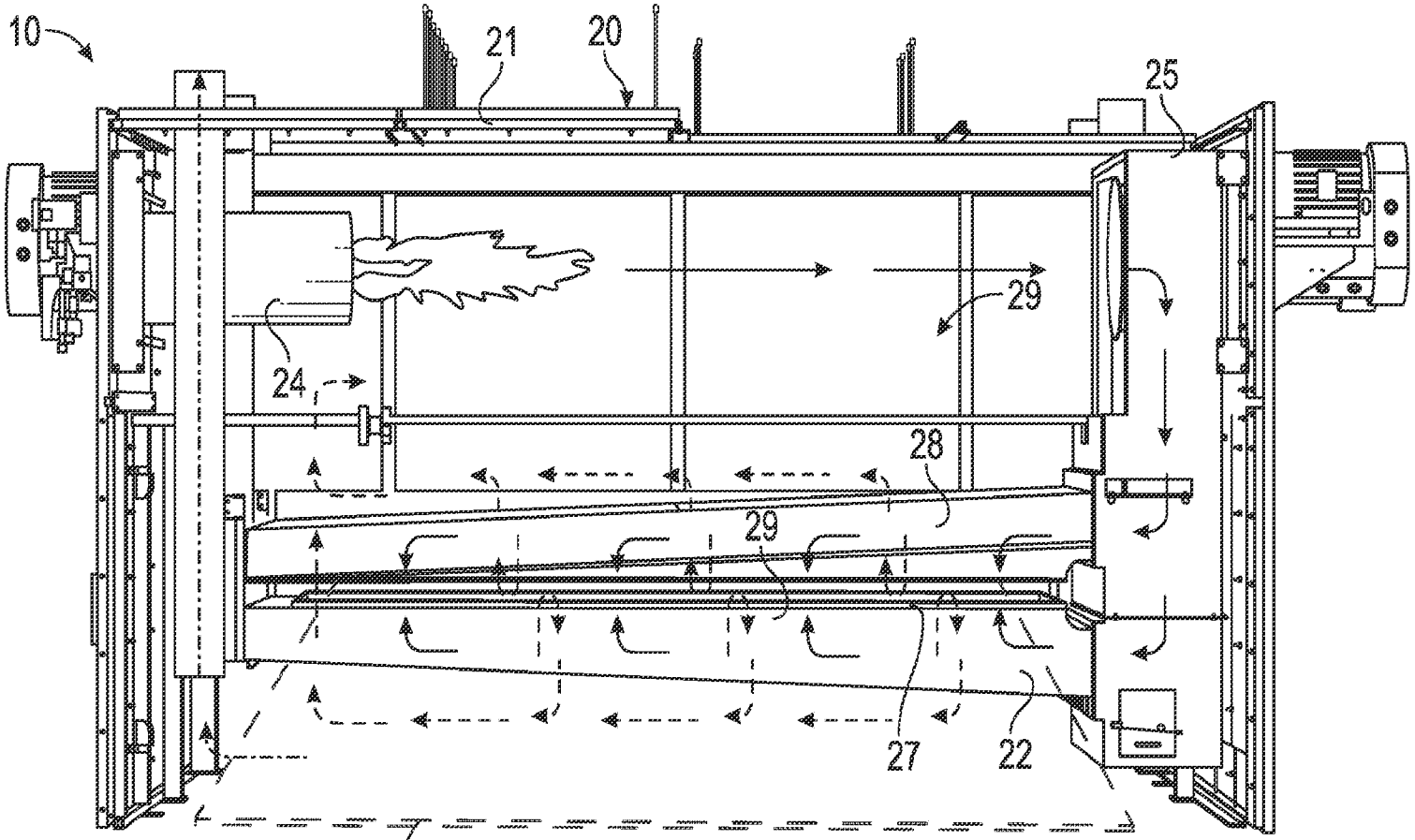
FIG. 1 is a side elevational diagram of a carpet drying machine and the nozzle system of the present invention.
Figure 2:
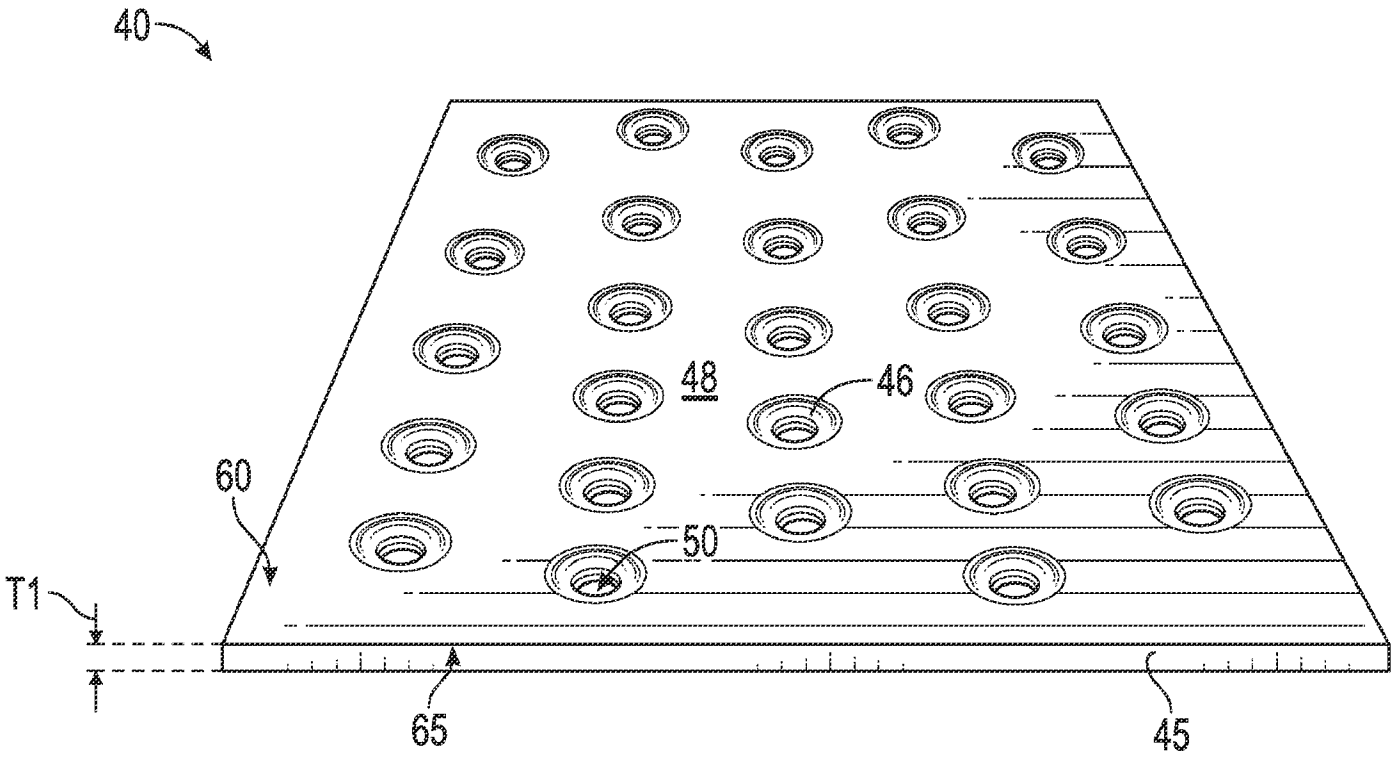
FIG. 2 is a perspective view of a manifold side of a diffusion plate of the invention.

FIGS. 1 and 2 illustrate a nozzle system for a carpet drying machine 20 of the type having an upper manifold 28 with a lower open end 27, and a lower manifold 22 with an upper open end 23. Each manifold 22,28 is in fluid communication with at least one furnace 24 and a blower 25 to deliver heated air through the manifold 22,28 to a carpet web 30 disposed between each manifold 22,28.

Each manifold 22, 28 can have an inlet end 28A and a distal end 28B, opposite the inlet end 28A. The inlet end 28A receives the air moved by the blower 25. The manifolds 22, 28 can have a cross-sectional area at the inlet end 28A that continuously decreases toward the distal end 28B thereof. For example, a top side of the manifold 22, 28 can slope downward from the inlet end 28A to the distal end 28B as can be seen in FIG. 3B, for example.

The nozzle system 10 comprises two or more planar diffusion plates 40 each having a manifold side 48 and a carpet side 42. The diffusion plates 40 each includes a plurality of apertures 50 traversing from the manifold side 48 to the carpet side 42. Each aperture 50 is wider at the manifold side 48 than at the carpet side 42 so as to define a concentrating nozzle 51 through the diffusion plate 40. Each diffusion plate 40 preferably is made from a metal material, such as aluminum or steel, having a thickness $T_1$ of at least 3/8 of an inch, typically from about 3/8 inch to about 3/4 inch, more typically from 3/8 inch to about 5/8 inch.

Preferably the concentrating nozzles 51 of each diffusion plate 40 flare outwardly progressively increasingly from the carpet side 42 of the diffusion plate 40 to the manifold side 48 of the diffusion plate 40. Preferably each diffusion plate 40 includes two or more rows 60 of the concentrating nozzles 51, each concentrating nozzle 51 of one row 60 being offset from the concentrating nozzles of any adjacent row 65 of concentrating nozzles 51 (FIG. 2). Preferably each concentrating nozzle 51 include only rounded, non-sharp edges 46 that inhibit snagging on the carpet web 30.

Figures 3A, 3B:
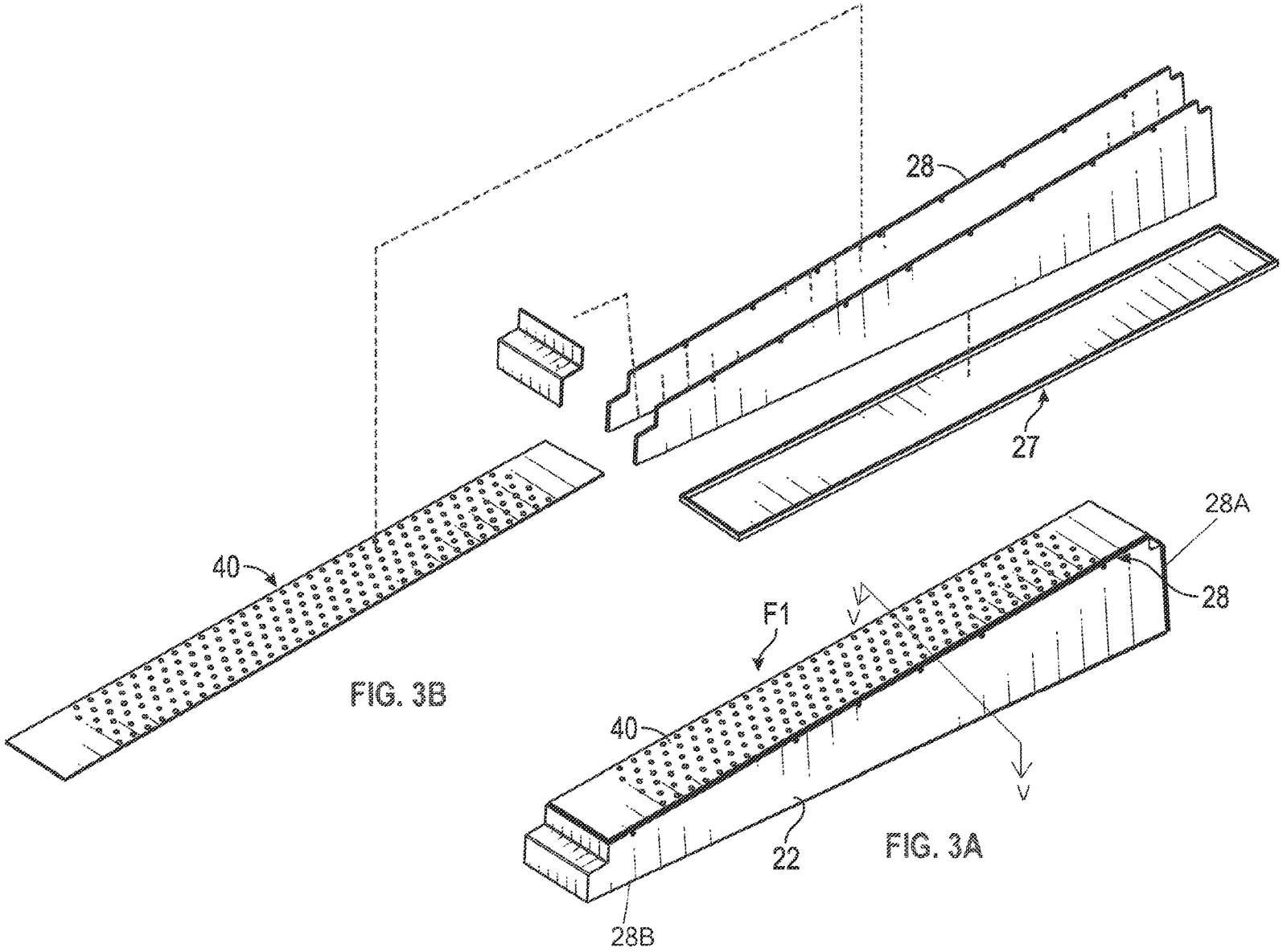
FIG. 3A is an exploded perspective view of a lower manifold with one of the diffusion plate.
FIG. 3B is a perspective view of the lower manifold with one of the diffusion plate.
Figure 4:
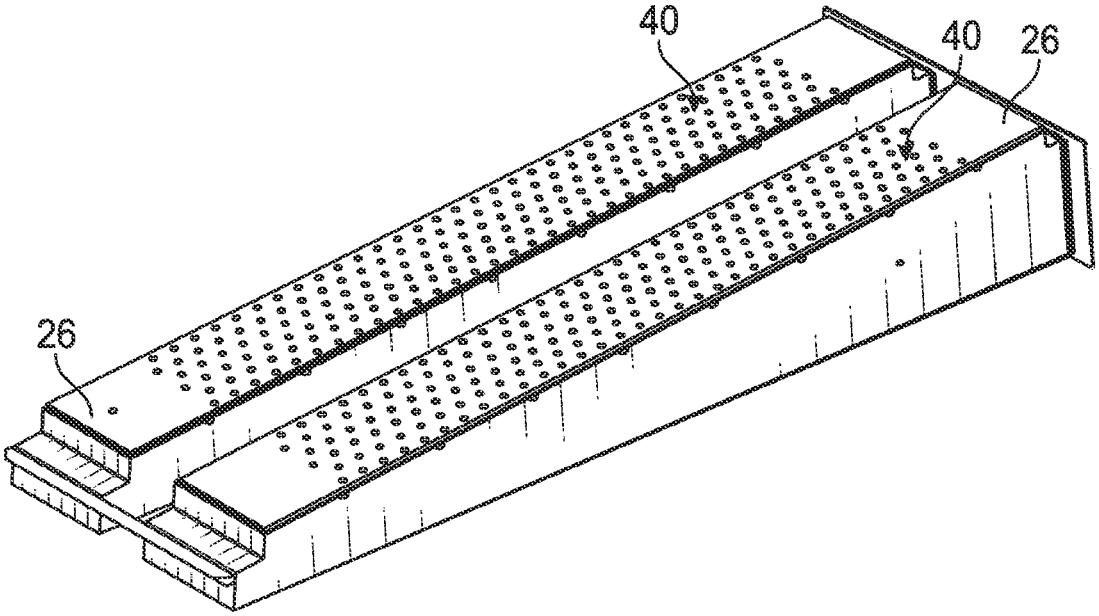
FIG. 4 is a perspective view of a double lower manifold, each with one or more of the diffusion plates.

Each diffusion plate 40 preferably is adapted to rest in either manifold 22,28 by gravity at the open end 23,27 of each manifold 22,28, respectively (FIGS. 3A and 3B). Each diffusion plate 40 is preferably rectangular in plan view, and possibly square in plan view when multiple of the diffusion plates 40 are required to completely cover the open end 23,27 of each manifold 22,28. As such, each diffusion plate 40 abuts any adjacent diffusion plate 40 along a cooperative edge 45 that inhibits air flow between the adjacent diffusion plates 40. In some embodiments, the lower manifold 22 and/or the upper manifold 28 include two or more sections 26 (FIG. 4), each having one or more of the diffusion plates 40 and a gap between adjacent such sections 26 to allow air to flow therebetween.

Figure 5:
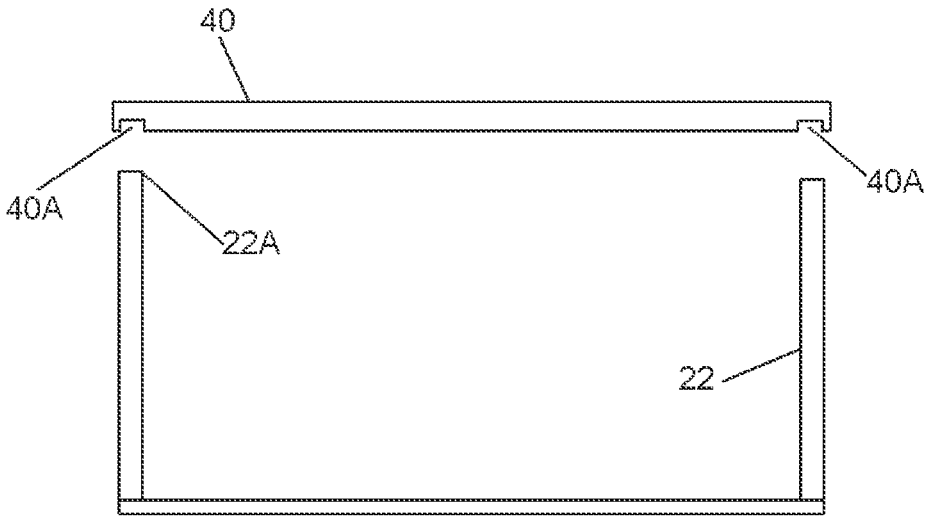
FIG. 5 is a cross-sectional view taken along line V-V of FIG. 3A, illustrating one exemplary configuration of the diffusion plate and manifold side wall interface.
Figure 6:
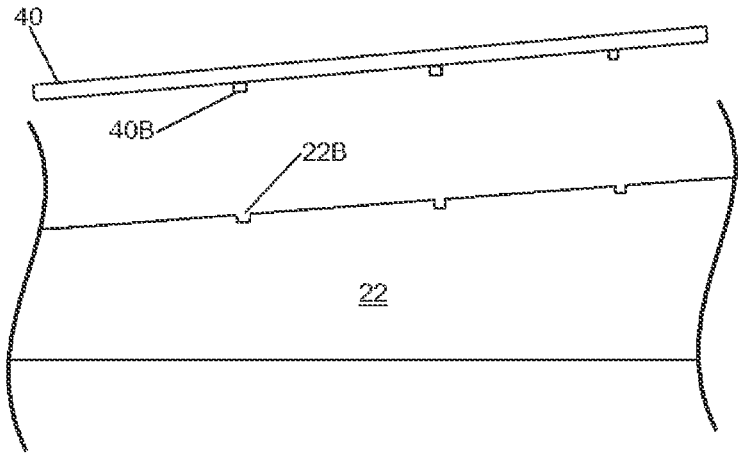
FIG. 6 is a detailed side view of the manifold side wall and distribution, illustrating an alternate exemplary configuration for orientation thereof.

In some embodiments, each diffusion plate 40 can include a slot 40A designed to fit on the upper ends 22A of the side walls of the manifold 22, 28, as shown in FIG. 5. The diffusion plate 40 can be removably placed on the manifold 22, 28 to permit a user to change the manifolds to allow a greater air velocity, a greater air flow, or a greater or lesser number of nozzles, for example. In some embodiments, the sides of the manifold 22, 28 can include indents 22B that can accept protrusions 40B formed on an underside (manifold side 48) of the diffusion plate 40. The protrusions 40B can fit into the indents 22B to removably secure the diffusion plate 40 to the manifold 22, 28.

As such, with the two or more diffusion plates 40 mounted at each of the open ends Each diffusion plate 40 preferably is adapted to rest in either manifold 22,28 by gravity at the open end 23,27 of each manifold 22,28, respectively. Each diffusion plate 40 is preferably rectangular in plan view, and possibly square in plan view when multiple of the diffusion plates 40 are required to completely cover the open end 23,27 of each manifold 22,28. As such, each diffusion plate 40 abuts any adjacent diffusion plate 40 along a cooperative edge 45 that inhibits air flow between the adjacent diffusion plates 40.

As such, with the two or more diffusion plates 40 mounted at each of the manifolds 22,28 with the manifold side 48 of the diffusion plate 40 facing away from the carpet web 30, hot air blown into the manifolds 22,28 is concentrated into a laminar flow towards the carpet web 30 to dry the carpet web 30.

In some embodiments, the nozzle system 10 is added to a preexisting carpet drying machine 20 with minimal retrofitting required to the upper and lower manifolds 28,22. In other embodiments, the carpet drying machine 20 is included, the carpet drying machine 20 including at least one furnace 24 and at least one blower 25, each disposed in a penthouse 29 of an enclosure 21. In some embodiments each manifold 28,22 may include its own furnace 24 and blower 25 (not shown), such that the upper manifold 28 that dries a carpet-side of the carpet web 30 may be set at one temperature, for example, at 275 degrees Fahrenheit, and with a stronger air flow such as 5000 cfm, whereas a carpet-back side of the carpet web 30 may be dried at 375 degrees Fahrenheit and with a lower air flow, such as 3500 cfm. A plurality, such as 12 to 20 of such carpet drying machines 20 may be daisy-chained or attached for more thorough drying of the carpet web 30 in a continuous drying process, the carpet web being moved through the plurality of carpet drying machines at a rate of, for example, 220 ft/min.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms.

Accordingly, the inventor reserves the right to add additional claims after filing the application to pursue such additional claim forms for other aspects of the invention.

What is claimed is:

1. A nozzle system for a carpet drying machine of the type having an upper manifold with a lower open end and a lower manifold with an upper open end, each manifold in fluid communication with a furnace and a blower to deliver heated air through the manifold to a carpet web disposed between each manifold, the nozzle system comprising:

two or more planar diffusion plates each having a manifold side and a carpet side, each diffusion plate having a plurality of apertures traversing from the manifold side to the carpet side, each aperture wider at the manifold side than at the carpet side so as to define a concentrating nozzle through the diffusion plate, each diffusion plate having a thickness of at least 3/8 of an inch;

wherein each diffusion plate removably rests on respective open ends of respective manifolds;

wherein each diffusion plate includes a slot along an underside thereof, the slot fitting on a side wall terminus at the open end of the respective manifold;

wherein the concentrating nozzle of each diffusion plate each flare outwardly progressively increasing from the carpet side of the distribution plate to the manifold side of the distribution plate;

whereby with each diffusion plate mounted at one of the open ends of one of the manifolds with the manifold side of the diffusion plate facing away from the carpet web, hot air blown into the manifolds is concentrated into a laminar flow towards the carpet web to dry the carpet web.

2. The nozzle system of claim 1, wherein a cross-sectional area of each manifold progressively decreases from an inlet to the manifold to a side opposite the inlet.

3. The nozzle system of claim 1 wherein each diffusion plate includes two or more rows of the concentrating nozzles, each concentrating nozzle of one row being offset from the concentrating nozzles of any adjacent row.

4. The nozzle system of claim 1 wherein each diffusion plate is adapted to rest by gravity at the open end of each manifold.

5. The nozzle system of claim 1 wherein each diffusion plate is substantially square in shape in plan view, and wherein two or more of the diffusion plates are needed to cover the open end of each manifold.

6. The nozzle system of claim 5 wherein each diffusion plate abuts any adjacent diffusion plate along a cooperative edge that inhibits air flow therebetween.

7. The nozzle system of claim 1 wherein the diffusion plate is made with aluminum or an aluminum alloy.

8. The nozzle system of claim 7 wherein the concentrating nozzles include only rounded, non-sharp edges to inhibit snagging on the carpet web.

9. A nozzle system for a carpet drying machine of the type having an upper manifold with a lower open end and a lower manifold with an upper open end, each manifold in fluid communication with a furnace and a blower to deliver heated air through the manifold to a carpet web disposed between each manifold, the nozzle system comprising:

two or more planar diffusion plates each having a manifold side and a carpet side, each diffusion plate having a plurality of apertures traversing from the manifold side to the carpet side, each aperture wider at the manifold side than at the carpet side so as to define a concentrating nozzle through the diffusion plate, each diffusion plate having a thickness of at least 3/8 of an inch;

wherein each diffusion plate includes a slot along an underside thereof, the slot fitting on a side wall terminus at the open end of the respective manifold;

wherein a cross-sectional area of each manifold progressively decreases from an inlet to the manifold to a side opposite the inlet;

wherein the concentrating nozzles of each diffusion plate each flare outwardly progressively increasing from the carpet side of the distribution plate to the manifold side of the distribution plate;

whereby with each diffusion plate mounted at one of the open ends of one of the manifolds with the manifold side of the diffusion plate facing away from the carpet web, hot air blown into the manifolds is concentrated into a laminar flow towards the carpet web to dry the carpet web.

10. The nozzle system of claim 9 wherein each diffusion plate includes two or more rows of the concentrating nozzles, each concentrating nozzle of one row being offset from the concentrating nozzles of any adjacent row.

11. The nozzle system of claim 9 wherein each diffusion plate is adapted to rest by gravity at the open end of each manifold.

12. The nozzle system of claim 9 wherein each diffusion plate is substantially square in shape in plan view, and wherein two or more of the diffusion plates are needed to cover the open end of each manifold.

13. The nozzle system of claim 12 wherein each diffusion plate abuts any adjacent diffusion plate along a cooperative edge that inhibits air flow therebetween.

14. The nozzle system of claim 9 wherein each diffusion plate is made with aluminum or an aluminum alloy.

15. The nozzle system of claim 14 wherein the concentrating nozzles include only rounded, non-sharp edges to inhibit snagging on the carpet web.

* * * * *